US006822610B2

(12) United States Patent
Yeh

(10) Patent No.: US 6,822,610 B2
(45) Date of Patent: Nov. 23, 2004

(54) PLANAR MONOPOLE ANTENNA OF DUAL FREQUENCY

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 9 days.

(21) Appl. No.: 10/403,123

(22) Filed: Apr. 1, 2003

(65) Prior Publication Data

US 2004/0196187 A1 Oct. 7, 2004

(51) Int. Cl.[7] ..... H01Q 1/38
(52) U.S. Cl. ..... 343/700 MS; 343/702
(58) Field of Search ..... 343/700 MS, 702, 343/846, 795

(56) References Cited

U.S. PATENT DOCUMENTS 6,650,296 B2 * 11/2003 Wong et al. ..... 343/700 MS
6,747,600 B2 * 6/2004 Wong et al. ..... 343/700 MS

* cited by examiner

*Primary Examiner*—Hoang V. Nguyen
(74) *Attorney, Agent, or Firm*—Bacon & Thomas, PLLC

(57) ABSTRACT

This invention is to provide a planar monopole antenna operable at two different frequency ranges comprising a patch line printed on a top of a dielectric substrate and having one end formed as a signal feed point; a ground metal plate printed on a bottom of the dielectric substrate; a first radiating element extended from the other end of the patch line beyond the ground metal plate and being perpendicular to the patch line and then further extended a predetermined distance in a direction parallel to the patch line toward and spaced apart from the ground metal plate; and a second radiating element operated at a high frequency projected from a side of the patch line beyond the ground metal plate and spaced apart from the first radiating element operated at a low frequency.

2 Claims, 8 Drawing Sheets

PLANAR MONOPOLE ANTENNA OF DUAL FREQUENCY

FIELD OF THE INVENTION

The present invention relates to antennas and more particularly to an improved planar monopole antenna capable of operating at two different frequency ranges.

BACKGROUND OF THE INVENTION

Portion of a conventional antenna having parallel rods (i.e., so called Lecher wires) mounted on a TV is shown FIG. 1. Opposite current flows as indicated by arrows will be induced on two parallel metal (e.g., copper) radiating rods 14 of the antenna when they are close enough. Also, respective electromagnetic fields are generated around the radiating rods 14 by the induced current. But the electromagnetic fields will be cancelled each other due to opposite directions, resulting in a prohibition of radiation. For enabling the antenna to effectively radiate electromagnetic waves in a narrow space, the open ends of the radiating rods 14 are bent about 90 degrees in opposite directions to form signal feed lines 242 as shown in FIG. 2. As a result, current flows on the signal feed lines 242 are in the same direction as indicated by arrows. This antenna is so called dipole antenna. The dipole antenna comprises two parallel rods as feed lines 24 in a structure of balance transmission line. Portions of the feed lines 24 as implemented in the structure of balance transmission line are bent to form the above signal feed lines 242 which are extended the same lengths. A length of each signal feed line 242 is about one-quarter wavelength at a resonant frequency (e.g., $\lambda/4$ where $\lambda$ is wavelength at the resonant frequency). In other words, a total length of the signal feed lines 242 is about one half wavelength at the resonant frequency (e.g., $\lambda/2$). As such, the signal feed lines 242, each having about one-quarter wavelength, are used by the antenna as radiating elements. Such antenna is also called half wave dipole antenna which is typically operated at a single frequency.

For making the conventional antenna more compact, a technique of manufacturing the antenna on a printed circuit board is adopted by some manufacturers in the art as shown in FIGS. 3 and 4. This kind of patch antenna comprises a dielectric substrate 37, a patch line 34 printed on the top of the dielectric substrate 37, the patch line 34 having one end formed as a signal feed point 341, a ground metal plate 38 printed on the bottom of the dielectric substrate 37 opposite to the patch line 34, and an inverted L-shaped radiating element 342 formed at the other end of the patch line 34, the inverted L-shaped radiating element 342 being extended in a direction perpendicular to the patch line 34 above and beyond the ground metal plate 38, forming a so-called monopole antenna. The monopole antenna takes advantage of image theory employed by the ground metal plate 38 to map the patch line 34 and the inverted L-shaped radiating elements 342 of this structure of unbalanced transmission line. As an end, an antenna having radiating elements equivalent to the above dipole antenna is formed. The antenna is also typically operated at a single frequency.

There has been a significant growth in wireless local Area network (WLAN) due to an increasing demand of mobile communication products in recent years in which IEEE 802.11 WLAN protocol is the most important one among a variety of WLAN standards. The IEEE 802.11 WLAN protocol was established in 1997. The IEEE 802.11 WLAN protocol not only provides many novel functions for WLAN based communication but also proposes a solution for communicating between mobile communication products made by different manufacturers. There is no doubt that the use of the IEEE 802.11 WLAN protocol is a milestone in the development of WLAN. The IEEE 802.11 WLAN protocol was further modified for being adapted to serve as a standard of both IEEE/ANSI and ISO/IEC in August 2000. The modifications comprise IEEE 802.11*a* WLAN protocol and IEEE 802.11*b* WLAN protocol. In an expanded standard physical layer, the operating frequencies have to be set at 5 GHz and 2.4 GHz. As such, the well-known L-shaped antenna cannot satisfy the requirement of enabling a mobile communication product to use both IEEE 802.11*a* and IEEE 802.11*b* WLAN protocols at the same time. Instead, several antennas have to be mounted in the product for complying with the requirement of frequency band. However, such can increase a manufacturing cost, complicate an installation procedure, and consume precious space for mounting the antennas. As a result, the size of the product cannot be reduced, thereby contradicting the compactness trend.

SUMMARY OF THE INVENTION

A primary object of the present invention is to provide a planar monopole antenna capable of operating at two different frequency ranges for fulfilling the need of multi-frequency operation which is unobtainable by a conventional monopole antenna only operated at a single frequency.

One object of the present invention is to provide a planar monopole antenna operable at two different frequency ranges comprising a dielectric substrate; a patch line printed on a top of the dielectric substrate, the patch line having one end formed as a signal feed point; a ground metal plate printed on a bottom of the dielectric substrate; a first radiating element operated at a low frequency extended from the other end of the patch line beyond the ground metal plate and being perpendicular to the patch line in either direction, the first radiating element operated at a low frequency being further extended a predetermined distance in a direction parallel to the patch line toward and spaced apart from the ground metal plate in which a length of the first radiating element operated at a low frequency extended from the patch line beyond the ground metal plate is about one-quarter wavelength at a low operating frequency of the frequency ranges; and a second radiating element operated at a high frequency projected from a side of the patch line beyond the ground metal plate; the second radiating element being spaced apart from the first radiating element operated at a low frequency. By utilizing the antenna, the radiating elements can receive signals of dual frequency.

The above and other objects, features and advantages of the present invention will become apparent from the following detailed description taken with the accompanying drawings.

DETAILED DESCRIPTION OF THE PREFERRED EMBODIMENTS

Figure 1:
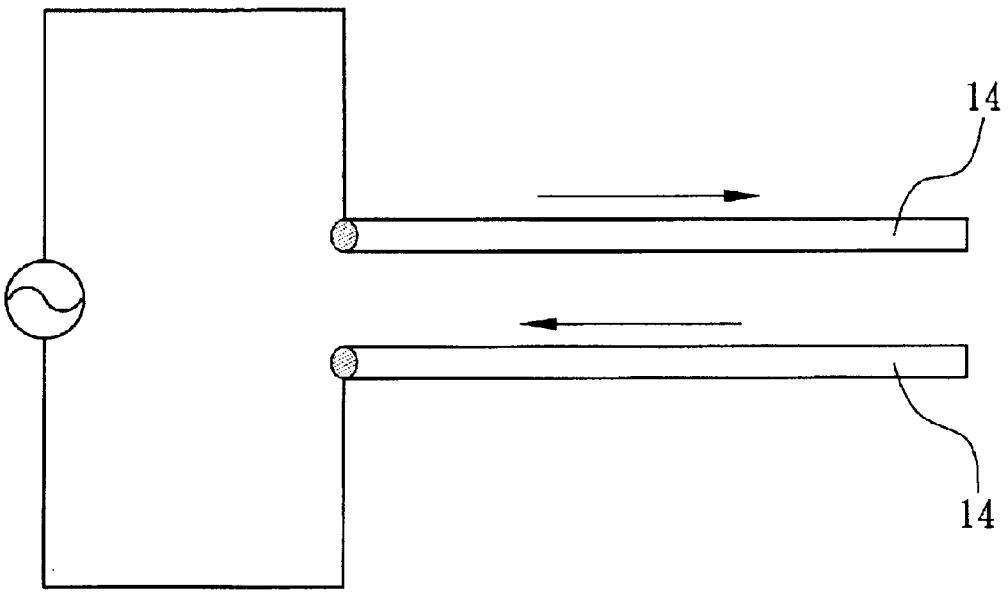
FIG. 1 (Prior Art)
FIG. 1 is a schematic diagram of Lecher wire of a conventional antenna.
Figure 2:
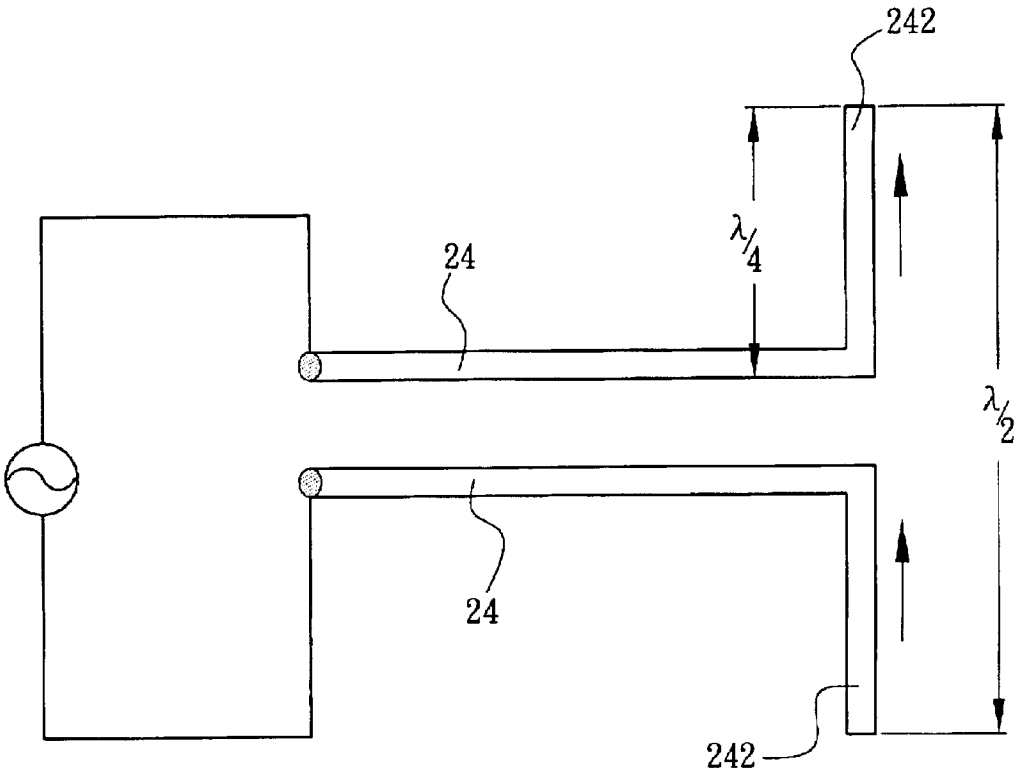
FIG. 2 (Prior Art)
FIG. 2 is a schematic diagram of a conventional dipole antenna.
Figure 3:
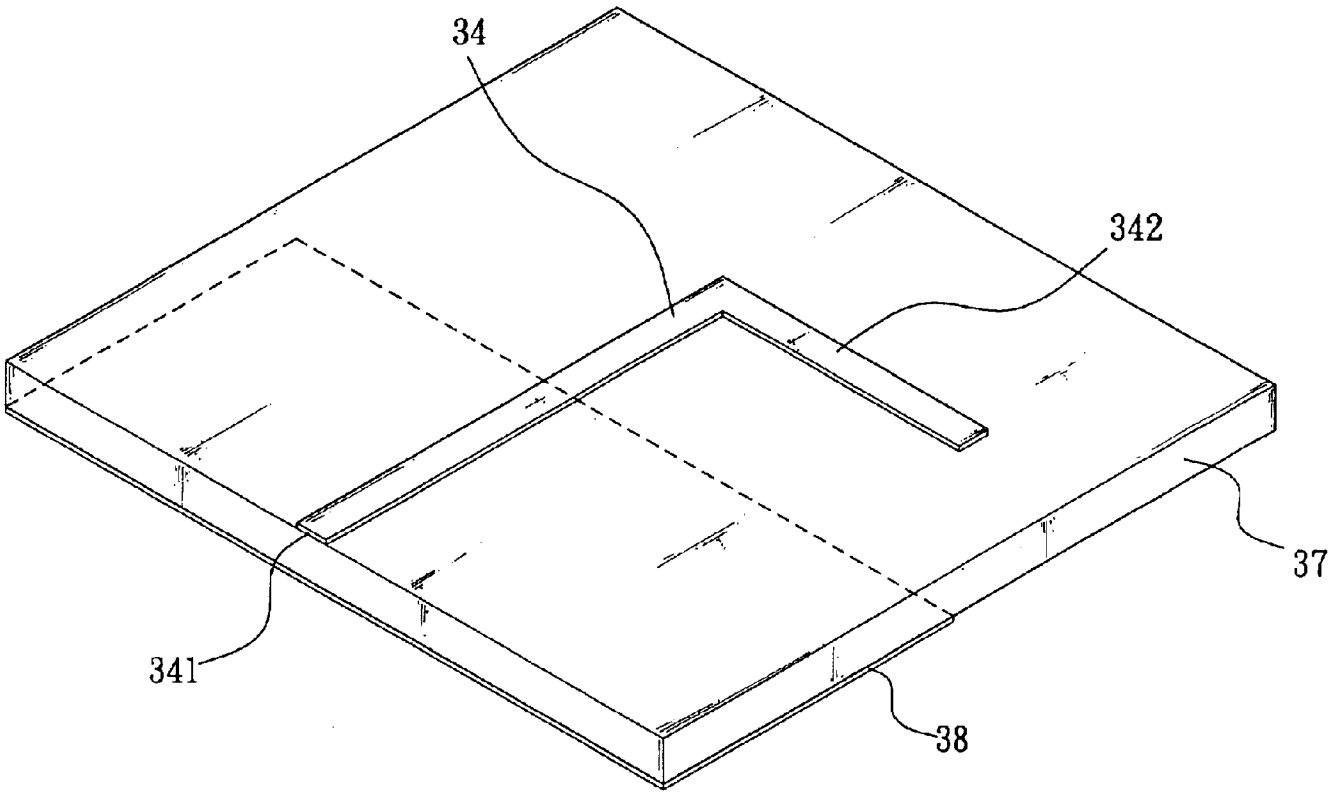
FIG. 3 (Prior Art)
FIG. 3 is a perspective view of a conventional patch based monopole antenna.
Figure 4:
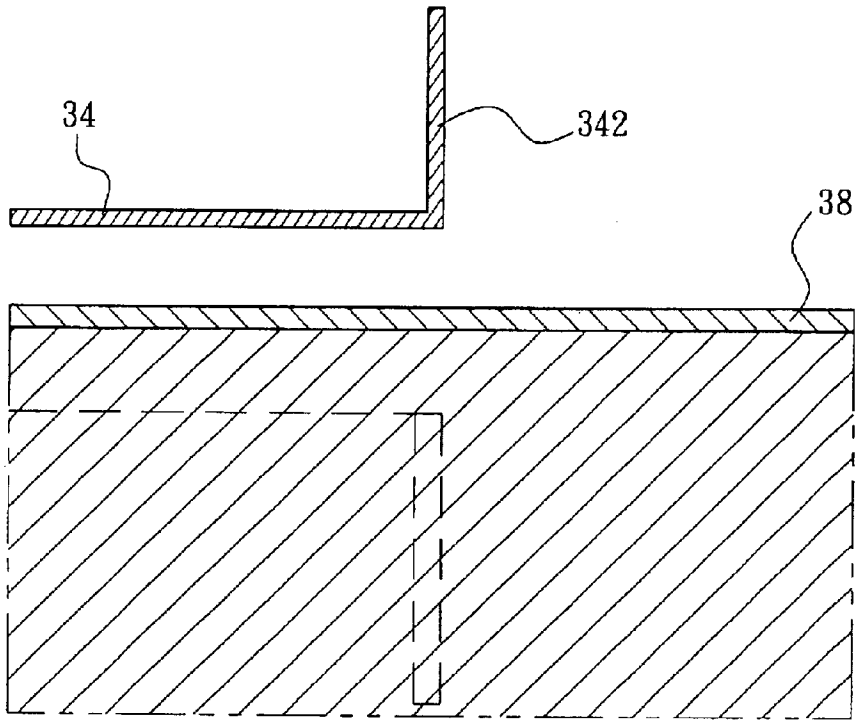
FIG. 4 (Prior Art)
FIG. 4 is a cross-sectional view of the antenna shown in FIG. 3.
Figure 5:
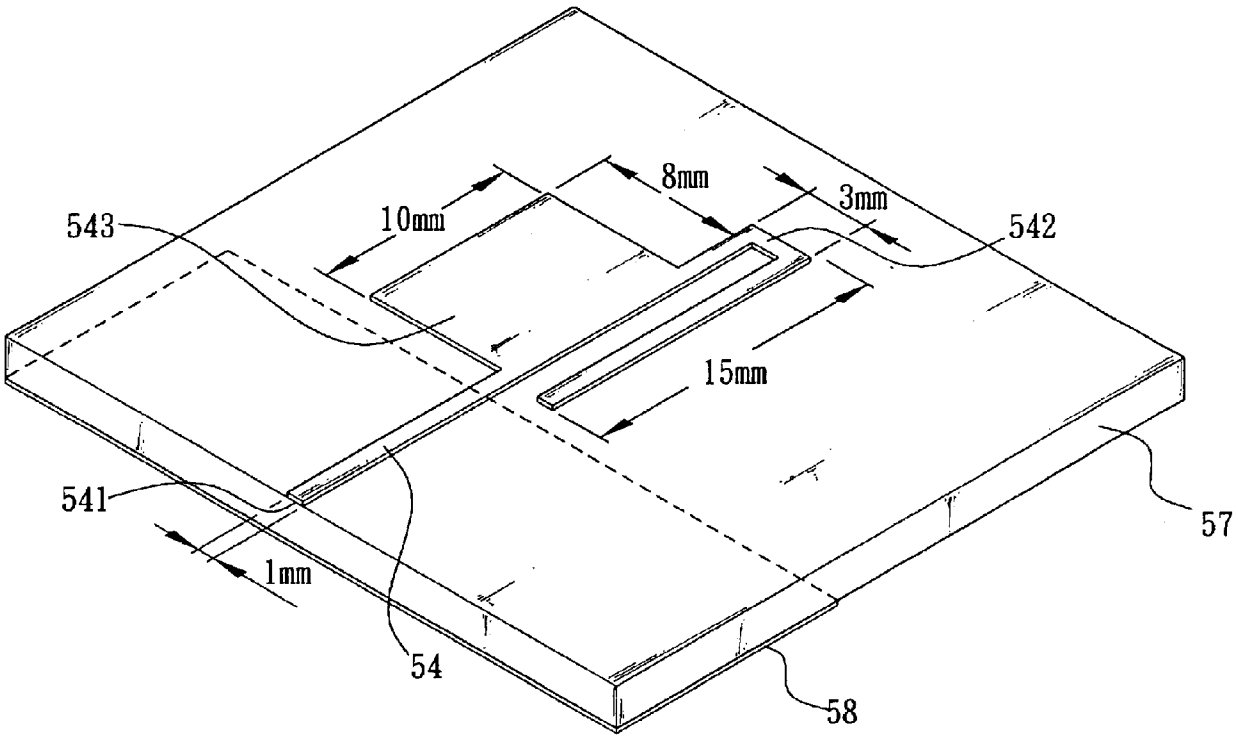
FIG. 5 is a perspective view of a first preferred embodiment of planar monopole antenna of dual frequency according to the invention.

Referring to FIG. 5, there is shown a planar monopole antenna of dual frequency in accordance with a first preferred embodiment of the invention. The antenna comprises a dielectric substrate 57, a patch line 54 having a predetermined input impedance of 50 ohms printed on the top of the dielectric substrate 57, the patch line 54 having one end formed as a signal feed point 541, a ground metal plate 58 printed on the bottom of the dielectric substrate 57 opposite to the patch line 54. The antenna further comprises a first radiating element 542 operated at a low frequency is extended from the other end of the patch line 54 beyond the ground metal plate 58 and being perpendicular to the patch line 54. And in turn, the first radiating element 542 operated at a low frequency is extended in a direction parallel to the patch line 54 toward the ground metal plate 58 until terminated at a point proximate the ground metal plate 58. Also, a rectangular plate 543 is projected from a side of the patch line 54 beyond the ground metal plate 58. The plate 543 can increase a bandwidth of high frequency at resonance. Hence, the plate 543 is used as a second radiating element 543 operated at a high frequency of the antenna. As an end, the radiating elements 542, 543 are capable of receiving signals having different frequencies.

Figure 6:
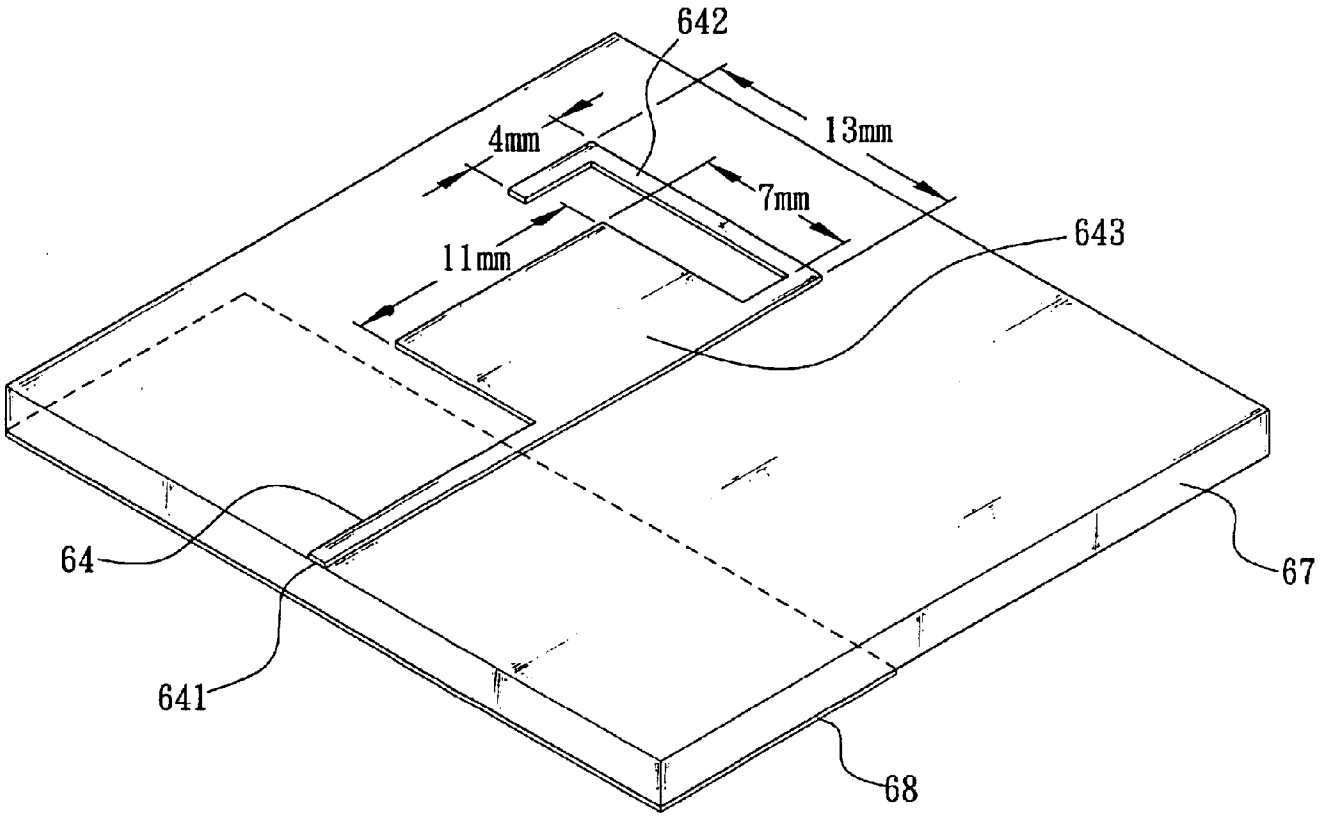
FIG. 6 is a perspective view of a second preferred embodiment of planar monopole antenna of dual frequency according to the invention.

Referring to. FIG. 6, there is shown a planar monopole antenna of dual frequency in accordance with a second preferred embodiment of the invention. The antenna comprises a dielectric substrate 67, a patch line 64 having a predetermined input impedance of 50 ohms printed on the top of the dielectric substrate 67, the patch line 64 having one end formed as a signal feed point 641, a ground metal plate 68 printed on the bottom of the dielectric substrate 67 opposite to the patch line 64, and a first radiating element 642 operated at a low frequency is extended from the other end of the patch line 64 beyond the ground metal plate 68 and being perpendicular to the patch line 64. And in turn, the first radiating element 642 operated at a low frequency is extended a short distance in a direction parallel to the patch line 64 toward the ground metal plate 68. In other words, an open end of the first radiating element 642 operated at a low frequency is spaced apart from the ground metal plate 68. The antenna further comprises a rectangular plate 643 projected from the side of the patch line 64 beyond the ground metal plate 68. The plate 643 is at the same side as and spaced apart from the first radiating element 642. The plate 643 can increase a bandwidth of high frequency at resonance. Hence, the plate 643 is used as a second radiating element 643 operated at a high frequency of the antenna. As an end, the radiating elements 642, 643 are capable of receiving signals having different frequencies.

Referring to FIGS. 5 and 6 again, in the above preferred embodiments the radiating elements 542, 543 or the radiating elements 642, 643 are designed to receive signals having different frequencies. Hence, a length of each of the radiating elements 542, 543 (or 642, 643) extended from the patch line 54 (or 64) above and beyond the ground metal plate 58 (or 68) is closely related to a distinct resonant frequency of a corresponding antenna. In the above preferred embodiments of the invention, preferably, a length of each of the radiating elements 542, 543 (or 642, 643) extended from the patch line 54 (or 64) above and beyond the ground metal plate 58 (or 68) is about one-quarter wavelength at each operating frequency of two frequency ranges. As an end, the radiating elements of different lengths can receive signals of dual frequency as stipulated by IEEE 802.11*a* protocol and IEEE 802.11*b* protocol respectively.

Figure 7:
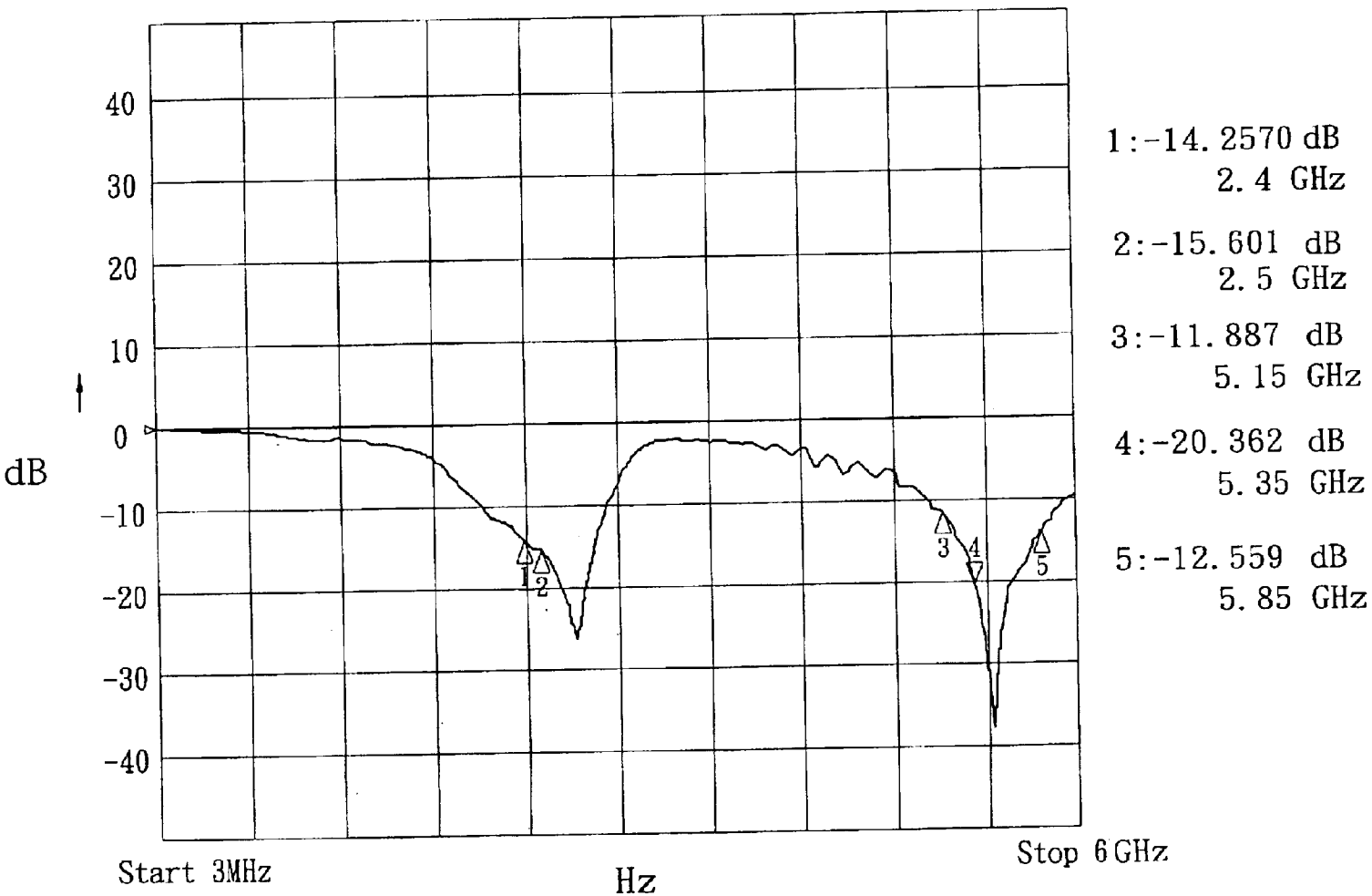
FIG. 7 is a graph showing return loss measured at the antenna of FIG. 5.

In the antenna of the first preferred embodiment of the invention (see FIG. 5), the patch line 54, the radiating elements 542, 543, and the ground metal plate 58 are printed on the top of the dielectric substrate 57 having a thickness about 0.8 mm and a dielectric coefficient from about 4.3 to about 4.7. This forms a planar monopole antenna of dual frequency of the invention. Each of the patch line 54 and the first radiating element 542 operated at a low frequency has a width about 1 mm. A length of the first radiating element 542 operated at a low frequency is about 18 mm. An area of the second radiating element 543 operated at a high frequency is about 80 $mm^2$. The antenna of the first preferred embodiment operates at two frequency ranges stipulated by IEEE 802.11*a* protocol and IEEE 802.11*b* protocol respectively. A return loss measured at each of the frequency ranges is shown in FIG. 7. It is seen that each return loss is less than 11 dB. In view of the measured return loss, the planar monopole antenna of dual frequency of the invention can receive signals of dual frequency.

Figure 8:
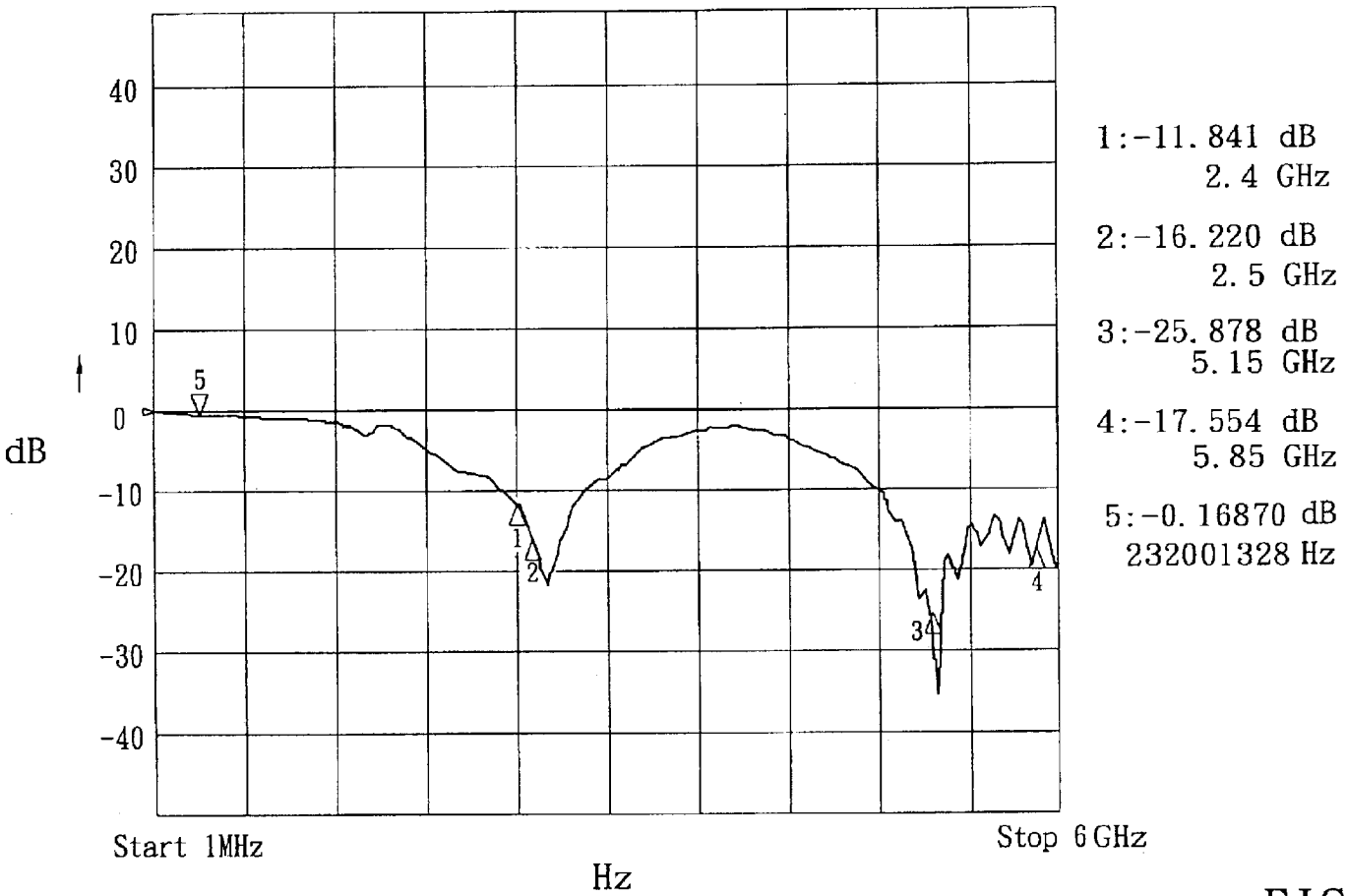
FIG. 8 is a graph showing return loss measured at the antenna of FIG. 6.

In the antenna of the second preferred embodiment of the invention (see FIG. 6), the patch line 64, the radiating elements 642, 643, and the ground metal plates 68 are printed on the dielectric substrate 67 having a thickness about 0.8 mm and a dielectric coefficient from about 4.3 to about 4.7. This forms a planar monopole antenna of dual frequency of the invention. Each of the patch line 64 and the first radiating element 642 operated at a low frequency has a width about 1 mm. A length of the first radiating element 642 operated at a low frequency is about 17 mm. An area of the second radiating element 643 operated at a high frequency is about 77 $mm^2$. The antenna of the second preferred embodiment operates at two frequency ranges stipulated by IEEE 802.11*a* protocol and IEEE 802.11*b* protocol respectively. A return loss measured at each of the frequency ranges is shown in FIG. 8. It is seen that each return loss is less than 11 dB. In view of the measured return loss, the planar monopole antenna of dual frequency of the invention can receive signals of dual frequency.

While the invention has been described by means of specific embodiments, numerous modifications and variations could be made thereto by those skilled in the art without departing from the scope and spirit of the invention set forth in the claims.

What is claimed is:

1. A planar monopole antenna operable at two different frequency ranges comprising:

a dielectric substrate;

a patch line printed on a top of the dielectric substrate, the patch line having one end formed as a signal feed point;

a ground metal plate printed on a bottom of the dielectric substrate;

a first radiating element operated at a low frequency extended from the other end of the patch line beyond the ground metal plate and being perpendicular to the patch line in either direction, the first radiating element operated at a low frequency being further extended a predetermined distance in a direction parallel to the patch line toward and spaced apart from the ground metal plate; and a second radiating element operated at a high frequency projected from a side of the patch line beyond the ground metal plate, the second radiating element being spaced apart from the first radiating element operated at a low frequency, wherein the first radiating element operated at a low frequency extended from the other end of the patch line beyond the ground metal plate is opposite to the second radiating element with respect to the patch line and proximate the ground metal plate.

2. The planar monopole antenna of claim 1, wherein a length of each of the radiating elements extended from the patch line beyond the ground metal plate is about one-quarter wavelength at each operating frequency of the frequency ranges.

* * * * *